United States Patent [19]

Siletto et al.

[11] 4,065,121

[45] Dec. 27, 1977

[54] SHEET DETACHING DEVICE FOR ELECTROPHOTOGRAPHIC COPYING MACHINE

[75] Inventors: Giorgio Siletto; Piero Bena, both of Turin; Bruno Cestari, Collegno (Turin), all of Italy

[73] Assignee: Ing. C. Olivetti & C., S.p.A., Ivrea (Turin), Italy

[21] Appl. No.: 738,197

[22] Filed: Nov. 3, 1976

[30] Foreign Application Priority Data

Nov. 10, 1976 Italy ..... 69760/76

[51] Int. Cl.[2] ..... B65H 29/56

[52] U.S. Cl. ..... 271/174; 271/DIG. 2

[58] Field of Search ..... 271/DIG. 2, 80, 174; 355/3 R; 118/245; 100/174; 34/120

[56] References Cited

U.S. PATENT DOCUMENTS

| | | | |
|---|---|---|---|
| 746,124 | 12/1903 | Mosher | 271/80 |
| 2,770,192 | 11/1956 | Mitchell et al. | 271/DIG. 2 X |
| 3,506,259 | 4/1970 | Caldwell et al. | 271/80 X |
| 3,649,115 | 3/1972 | Hodges | 271/DIG. 2 X |
| 3,981,085 | 9/1976 | Franko | 271/DIG. 2 X |

*Primary Examiner*—Robert W. Saifer
*Attorney, Agent, or Firm*—W. R. Hulbert

[57] ABSTRACT

Device for detaching a copy sheet from the photoconductive drum of an electrophotographic copying machine, wherein the drum has a radial protuberance to which the leading edge of the copy sheet is held by electrostatic attraction and wherein a pick off finger is fixedly mounted adjacent the periphery of the drum at such a distance from the periphery to engage the drum, during its rotation, only in correspondence with the protuberance, so as to detach the copy sheet from the drum.

5 Claims, No Drawings

SHEET DETACHING DEVICE FOR ELECTROPHOTOGRAPHIC COPYING MACHINE

BACKGROUND OF THE INVENTION

The present invention relates to a sheet detaching device for detaching a copysheet from the photoconductive drum of an electrophotographic copying machine.

It is well known from the prior art that in an electrophotographic copying machine a photoconductive element is wound or coated on the periphery of a drum which is rotated around its own axis for carrying the element in succession under the action of the following stations:

- charging station: wherein an electrostatic charge is uniformly deposited on the surface of the photoconductive element;
- exposure station: wherein the charged surface of the photoconductive element is exposed to the light image of the original to be reproduced, whereby a latent image of the original is formed on the photoconductive surface;
- developing station: wherein toner particles are attracted by the photoconductive surface so rendering the image visible;
- transfer station: wherein a copysheet of plain paper is carried in contact with the developed image while an electrostatic charge of opposite polarity with respect to the charge of the photoconductive surface is applied to the back of the sheet, whereby the toner particles are attracted to the copysheet of plain paper in image configuration;
- sheeting detaching station: wherein the copysheet carrying the toner particles is detached from the photoconductive surface against the force of attraction of the charges of opposite polarity located on the photoconductor and on the sheet respectively.

The sheet detaching devices usually comprise a corona charging device supplied with A.C. current, which renders ineffective the electrostatic attraction between the copy paper and the photoconductors by charging the copy paper with a continuously variable charge sign.

It is also known to add to the above A.C. corona charging device some mechanical devices to aid the detaching of the sheet.

Among mechanical devices of the above type, detaching fingers are known having a first inoperative position and a second working position into which they can be switched upon actuation, and in which they are inserted between the leading edge of the copy sheet and the photoconductive surface, during the rotation of the drum, so picking off the copy sheet from the drum.

It is also known to mount the detaching fingers within the drum in such a way that in their inoperative position they are within the drum, while, in their operative position, they come out from the periphery of the drum and insert themselves between the leading edge of the copy sheet and the photoconductive surface of the drum at the time that the leading edge of the sheet arrives in contact with the drum and thus before the transfer of the toner from photoconductor to the copy sheet.

This last type of device suffers from the disadvantage of covering with the fingers a portion of the photoconductive surface and thus a corresponding portion of toner image is not transferred to the copy-sheet.

A detaching device is also known in which the fingers are mounted adjacent the drum in such a way that they slide on the photoconductive surface. This type of device has the advantage of not requiring a special mechanism for its actuation in synchronism with the rotation of the drum, but it has also the disadvantage of causing the scraping of the photoconductive surface, expecially when the photoconductive element is a web around the drum.

SUMMARY OF THE INVENTION

It is therefore an object of the present invention to provide a detaching device which has no actuable element and which does not cause the deterioration of the photoconductive surface of the drum.

According to the invention, we provide a device for detaching a copy sheet held by electrostatic attraction to the photoconductive element carried by the drum of an electrophotographic copying machine comprising means defining a radial protuberance in the periphery of the drum between its surface and the photoconductive element in the zone in which the leading edge of the copy sheet contacts the element and a pick off finger fixedly mounted adjacent the drum at such a distance as to engage the element only in correspondence with the protuberance, whereby, during the rotation of the drum, the pick off finger engages the leading edge of the copy sheet and detaches it from the element. In preferred embodiments: — the photoconductive element comprises a web of photoconductive material carried by the drum surface and the means defining the radial protuberance comprises at least one pair of spacing members which extend radially upwardly from the drum surface and which are longitudinally spaced apart along the drum surface for lifting the web away from the surface in the aforementioned zone; the aforementioned distance is less than the radial height of the protuberance and the pick off finger engages the protuberance in the zone between the members so as to depress the web therebetween; the pick-off finger has a curved form for sliding, without scraping, on the photoconductive element during its enggement therewith; and an A.C. corona charging device is mounted adjacent the drum in a position in advance of the pick off finger for lowering the electrostatic force attracting the copy sheet to the element to facilitate its removal by the finger.

BRIEF DESCRIPTION OF THE DRAWINGS

These and other objects, features and advantages of the present invention will appear clear from the following description with reference to the accompanying drawings, in which.

DETAILED DESCRIPTION OF THE PREFERRED EMBODIMENT

Figure 1:
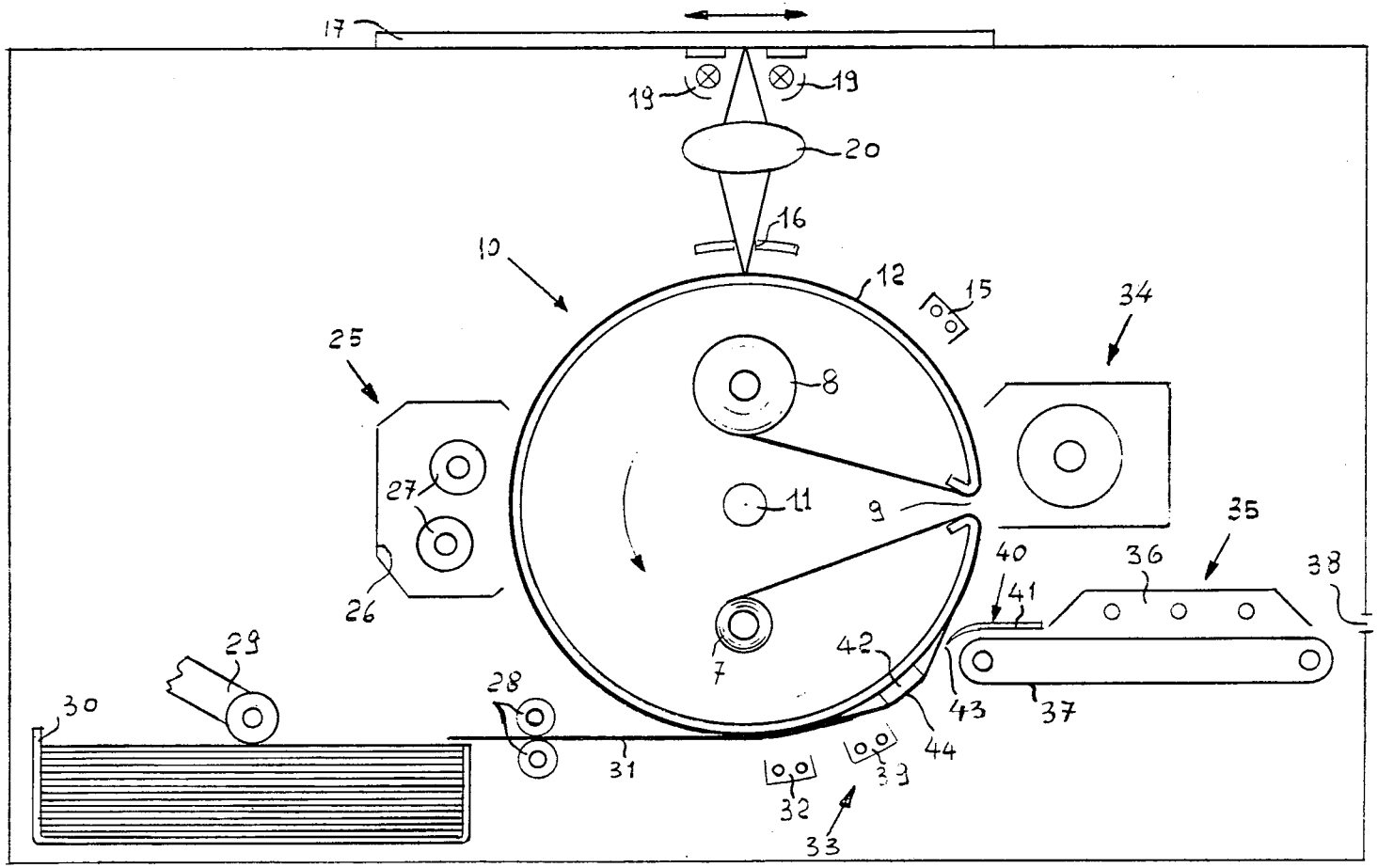
FIG. 1 is a side view of the preferred embodiment of the device according to the invention mounted on an electrophotographic copying machine.
Figure 3B:
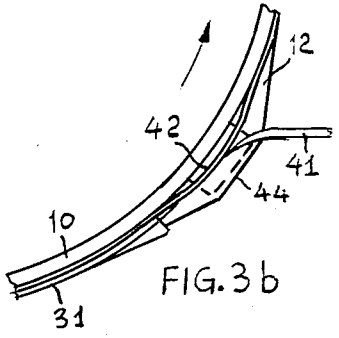
FIGS. 3*a*, 3*b*, 3*c*, 3*d* are four side views of the device of FIG. 1 in successive time instants starting from FIG. 3*a* and going towards FIG. 3*d*.
Figure 3D:
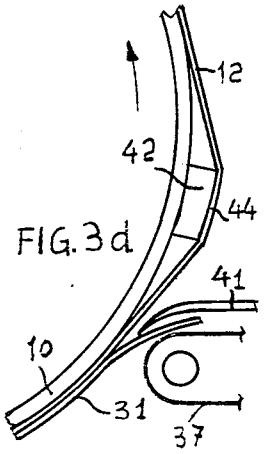
Figure 3A:
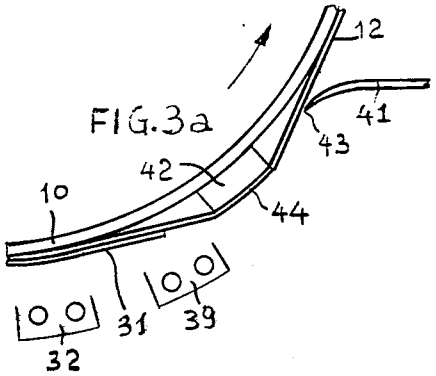
Figure 3C:
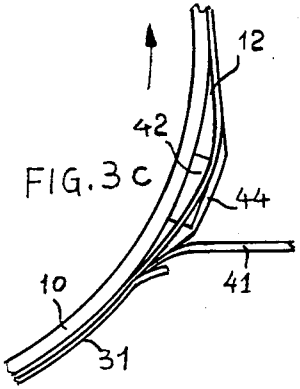

The copying machine of FIG. 1 comprises a drum 10 rotatable mounted on a shaft 11 and carrying wound on its cylindrical periphery a photoconductive web 12 fed from a feed reel 8 mounted inside the drum 10, through the slit 9 ad rewound through the slit 9 to a take up reel also mounted inside the drum 10.

Positioned adjacent and distributed around the periphery of the drum 10 are the following devices:

a corona charging device 15 for uniformly charging the photoconductive web 12, an exposure window 16 receiving through an optical system 20 the image of the original to be reproduced positioned on the carriage 17, a magnetic brush developing unit 25, a corona charging device 32 for the transfer of the powder image onto the copysheet fed to the transfer station from a cassette 30 by a feeding device 29 and feeding rollers 28 known per se, a sheet detaching unit 33 including an A.C. corona charging device 39 and, according to the invention, a fixed mechanical device 40 which will be better described below, a cleaning unit 34 known per se.

The carriage 17 carrying the original to be reproduced effects a first stroke from right to left (with reference to FIG. 1) in synchronism with the drum rotation during which the original is illuminated by the lamps 19 and the light image of the original is focused onto the charged photoconductive web 12 by the optical system 20 and through the exposure window 16, and a second return stroke from left to right during which the portion of the drum comprising the slit 9 passes in correspondance of the exposure window 16.

The copying machine 1 further comprises a fixing unit 35 having a fusing device 36 and a conveyor 37 suitable to receive the copy-sheet from the detaching unit 33 and to deliver it to the exit slit 38 of the machine after the fixing operation.

The detaching device according to the invention will be now described in detail with reference to FIGS. 1 and 2.

A pair of plaques 42 is mounted on the periphery of the drum parallel along a generatrix. The plaques 42 are symmetrically positioned with respect to the center line of the drum and have a thickness of about 2 mm. The photoconductive web is wound on the periphery of the drum passing over the plaques 42, therefore, at least in the zone comprised between the two plaques 42 and parallel to the drum axis, the photoconductive web is raised about 2 mm with respect to the cylindrical surface of the drum. Substantially the raising of the web 12 forms a protuberance 44 in the surface of the drum which has a thickness of about 2 mm.

Figure 2:
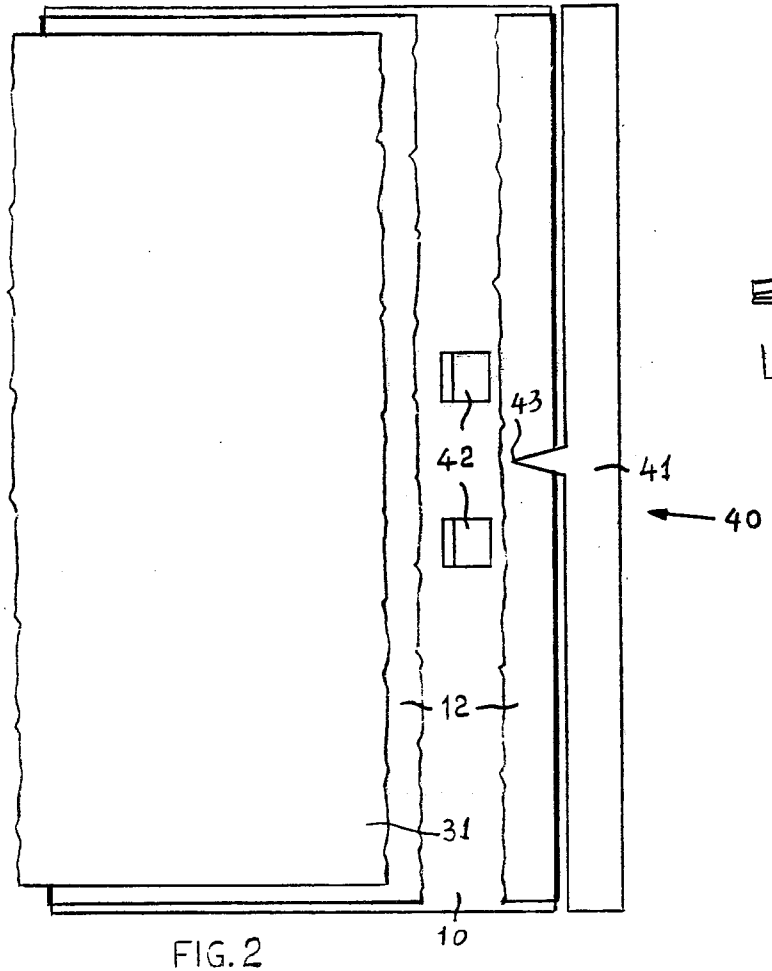
FIG. 2 is a bottom view of the device according to FIG. 1.

The drum 10 is mounted on the shaft 11 in such a manner that, during the execution of a copying cycle, the leading edge of the copying sheet is fed into contact with the drum 10 in the transfer station 32 at the time in which the protuberance 44 passes in correspondence with the transfer station 32, whereby the leading edge of the copy sheet contacts substantially the base of the protubernce 44, as is clearly visible in FIGS. 1 and 2.

As already said, the detaching mechanical element 40 is fixedly mounted with respect to the machine frame and adjacent the drum 10 in a position immediately successive to the A.C. corona 39 in the direction of rotation of the drum 10.

The detaching element 40 comprises a curved metallic lamina 41 extending parallel to the drum axis for all the drum length and having in correspondence with its center line a stylus 43 which constitutes the detaching finger.

The minimum distance between the lamina 41 and the periphery of the drum 10 in a portion outside of the protuberance 44 is of about 0.6–1 mm, less than the thickness of the plaques 42.

When the protuberance 44 passes in correspondence with the stylus 43, it contacts the web 12 in the zone comprised between the two plaques 42, while when the protuberance 44 is not in such a correspondence, the finger 43 does not interfere with the drum periphery.

The curved form of the lamina 41 is determined by the two functions which it performs: the first is that of causing with the finger 43 the separation of the leading edge of the copy sheet 12 from the photoconductive web 12, the second is that of deflecting and guiding the leading edge towards the conveyor 37 of the fixing unit 35.

The operation of the pick off device is shown by the succession of the FIGS. *3a, 3b, 3c, 3d.*

FIG. *3a* shows the relative position of the drum 10 and of the detaching device at the instant in which, during the copying cycle, the leading edge of the copying sheet already in contact with the photoconductive web 12 has passed the transfer corona device 32 and is under the effect of the A.C. corona 39. At the instant of FIG. *3a* the leading edge of the protuberance 44 is entering into contact with the finger 43.

FIG. *3b* shows the relative position of the drum 10 and the pick off device at a instant immediately successive to that of FIG. *3a*. In this figure the rotation of the drum 10 has carried the protuberance 44 in interference with the finger 43. As a consequence the detaching finger 43 pushes against the web 12 in the zone comprised between the two plaques and reduces substantially the height of the protuberance 44 in this zone. The curved form of the lamina 41 allows the finger 43 to slide on the photoconductive web 12 without scraping the web 12.

The pressure exerted by the detaching device 40 in the zone between the two plaques 42 causes therefore a depression in the corresponding portion of the web 12 which will aid the detaching of the leading edge of the copy sheet from the drum 10.

In fact as it is clearly shown in FIG. *3b* the copy sheet follows only partially the deformation of the web 12 under the pressure exerted by the detaching device 40, while, owing to its own weight, begins to separate from the web 12.

FIG. *3c* represents the relative position of the drum and of the copy sheet at instant successive to that of FIG. *3b*, when, continuing the drum rotation, the finger 43, pushing a sliding on the trailing edge of the protuberance 44, causes the definitive detaching of the leading edge of the copy sheet from the web 12. Contemporaneously the leading edge of the protuberance 44 is resuming its initial form.

FIG. *3d* represents the relative positioning of the drum and of the copy sheet after a further rotation of the drum 10 with respect to FIG. *3c*. In this situation the rotation of the drum 10 has carried the protuberance 44 out of the engagement with the detaching device 40, while the leading edge of the copysheet lies on the conveyor 37 of the fixing unit 35. In such a situation the lamina 41 acts as a guide for the portion of the copy sheet still in contact with the drum 10.

It is clear that the device till now described can be used also a in copying machine in which the photoconductive element is not a web 12 wound on the drum 10, but is a photoconductive layer coated on the cylindrical surface of the drum 10.

In such a case the protuberance 44 could not be obtained by the use of the two plaques 42 but it would be necessary to form it during the construction of the drum 10 or during the coating of the photoconductive layer.

Moreover in such a case the timing relation between the drum rotation and the feeding of the copy sheet should be such that the leading edge of the copy sheet arrives in contact with the top of the protuberance 44.

Finally, the minimum distance between the finger 43 and the photoconductive element 12 coated on the drum, outside of the protuberance 44, should not be less than the height of the protuberance 44, since in this last case the photoconductive element is not deformable under the pressure of the lamina 41 as in the case previously described; on the contrary, it is only possible for the finger to slide on the top of the protuberance 44 until the leading edge of the copysheet is detached and deflected.

It is preferred that the finger 43 and all the detaching device 40 have a certain elastic flexibility, which can be obtained by properly choosing the thickness of the lamina 41, in order to avoid scraping of the photoconductive element 12.

While the present invention has been described in conjunction with specific embodiments thereof, it is evident that many alternatives, modifications and variations will be apparent to those skilled in the art in light of the foregoing description. Accordingly it is intended to embrace all such alternatives, modifications and variations that fall within the spirit and broad scope of the appended claims.

What we claim is:

1. Device for detaching a copy sheet held by electrostatic attraction to the photoconductive element carried by the drum of an electrophotographic copying machine comprising:

means defining a radial protuberance in the periphery of the drum between its surface and said element in the zone in which the leading edge of the copy sheet contacts the element, a pick off finger fixedly mounted adjacent the drum at such a distance as to engage said element only in correspondence with said protuberance, whereby during the rotation of the drum the pick off finger engages the leading edge of the copy sheet and detaches it from the element.

2. Device for detaching according to claim 1, wherein the photoconductive element comprises a web of photoconductive material carried by the drum surface and wherein said means defining a radial protuberance comprises at least a pair of spacing members extending radially upwardly from the drum surface and spaced apart longitudinally of the drum surface for lifting the web away from said surface in said zone.

3. Device for detaching according to claim 2, wherein the said distance is less than the radial height of said protuberance and said pick off finger engages the protuberance between said members so as to depress said web therebetween thereby to aid the detaching of the leading edge of said copy sheet therefrom.

4. Device for detaching according to claim 1, wherein said pick-off finger has a curved form for sliding, without scraping, on said element during said engagement.

5. Device for detaching according to claim 1 further comprising an A.C. corona charging device mounted adjacent the drum in a position in advance of said pick off finger for lowering the electrostatic force attracting the copy sheet to said element to facilitate its removal by said finger.

* * * * *

UNITED STATES PATENT AND TRADEMARK OFFICE

CERTIFICATE OF CORRECTION

PATENT NO. : 4,065,121

DATED : December 27, 1977

INVENTOR(S) : Giorgi Siletto et al.

It is certified that error appears in the above-identified patent and that said Letters Patent are hereby corrected as shown below:

Under Foreign Application Priority Data,
"Nov. 10, 1976 Italy ..... 69760/76" should be
--Nov. 10, 1975 Italy ..... 69760/75

Column 1, line 35, "sheeting" should be --sheet--;

Column 2, line 44, "engagement" is misspelled;

Column 3, line 60, "protuberance" is misspelled;

Column 4, line 53, "a" should be --and--;

Column 4, line 68, "a in" should be --in a--.

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*